United States Patent [19]

Nusbaum

[11] Patent Number: 4,476,916

[45] Date of Patent: Oct. 16, 1984

[54] METHOD OF CASTING METAL MATRIX COMPOSITE IN CERAMIC SHELL MOLD

[76] Inventor: Henry J. Nusbaum, 109 Dickinson La., Wilmington, Del. 19807

[21] Appl. No.: 287,091

[22] Filed: Jul. 27, 1981

[51] Int. Cl.[3] ..... B22C 1/02; B22D 19/14

[52] U.S. Cl. ..... 164/519; 164/23; 164/97; 164/108

[58] Field of Search ..... 164/9, 10, 11, 34, 35, 164/36, 45, 63, 65, 97, 98, 108, 109, 519, 23

[56] References Cited

U.S. PATENT DOCUMENTS 3,153,824 10/1964 Holmes ..... 164/65

3,263,286 8/1966 Watts et al. ..... 164/45 X 4,312,398 1/1982 Van Blunk ..... 164/34 X

FOREIGN PATENT DOCUMENTS 46-39228 11/1971 Japan ..... 164/63

1410634 10/1975 United Kingdom ..... 164/519

576161 9/1977 U.S.S.R. ..... 164/34

*Primary Examiner*—Gus T. Hampilos

*Assistant Examiner*—J. Reed Batten, Jr.

[57] ABSTRACT

Method for investment casting of metal matrix composites by vacuum infiltration using a ceramic mold formed directly on the pattern.

5 Claims, 1 Drawing Figure

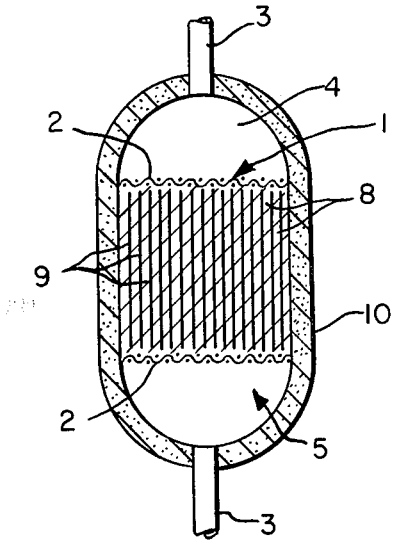
3
4
2
1
8
9
10
2
5
3

METHOD OF CASTING METAL MATRIX COMPOSITE IN CERAMIC SHELL MOLD

FIELD OF THE INVENTION

This invention relates to the fabrication of investment cast fiber reinforced metal matrix composites.

DESCRIPTION OF PRIOR ART

It is known to assist infiltration of inorganic fibers in a metal shell mold by application of vacuum or pressure assisted vacuum techniques. One such procedure is described in U.S. Pat. No. 3,828,839. A preform of alumina fiber in an organic binder is made and inserted in a metal mold. The binder of the preform is burned off by heating and molten magnesium is infiltrated using a vacuum. U.S. Pat. No. 3,828,839 points out that the molds can be made of any material sufficiently refractory to survive the temperatures of infiltration such as certain glasses, quartz, stainless steel, titanium and the like. Regardless of the material of the mold, it is the mold that is first formed and the preform is inserted into the mold. This procedure is not entirely satisfactory from the standpoint of the difficulty and expense of making the mold particularly when the composite to be cast is of complex shape or when only a few units of such shape are to be produced. U.S. Pat. No. 3,863,706 described an investment casting technique wherein molten metal enters cavities in a ceramic mold which is at a temperature below the melting point of the molten metal by virtue of suction through the wall of the mold caused by a lowering of pressure outside the mold. This technique would not provide the degree of infiltration into the fiber array required for the metal matrix-fiber composites contemplated in the present invention. The present invention provides a unique solution to these problems.

SUMMARY OF THE INVENTION

This invention provides a method for making an investment-cast, fiber reinforced metal matrix composite in a ceramic mold that involves forming a pattern of the composite, said pattern comprising a fiber array impregnated with a fugitive material and provided with conduits at locations to permit mold evacuation and mold filling, coating the pattern with a ceramic material that is not readily wetted by the metal to be cast when the metal is in the molten state, applying a plurality of additional coatings of a slurry of ceramic particles to the pattern to form a ceramic mold around the pattern, each of said coatings being dried after application, applying a coating of a ceramic sealant, treating the pattern to remove the fugitive material while leaving the fiber array substantially in place within the mold cavity, firing the ceramic sealant, heating the mold to a temperature above the melting point of the matrix metal, introducing molten matrix metal through a conduit into the mold cavity while applying a vacuum to the mold cavity through another conduit, infiltrating the fiber array with the molten metal, cooling the ceramic mold and removing it from the cast composite.

BRIEF DESCRIPTION OF THE DRAWING

The FIGURE is a cross-sectional schematic view of a ceramic mold with the pattern in place as used in the process of the invention.

DESCRIPTION OF THE PREFERRED EMBODIMENTS

In the process of the present invention, there is first prepared a pattern (1) corresponding to the shape and size of the desired fiber reinforced metal matrix composite. This is shown in the FIGURE as the material between the screens (2) in the mold cavity (5). The pattern comprises the fiber array (9) impregnated with fugitive material (8).

Metal fiber, carbon fiber, alumina fiber, glass fiber or silicon carbide fiber are examples of fiber that may be employed as reinforcement in the metal matrix composites prepared by the present process. The fiber selected should of course have a melting point or degradation temperature greater than the metal to be cast and be relatively inert thereto. Organic binders such as wax are particularly useful as the fugitive material. The fugitive material serves as a binder for the fiber array and can be readily removed as by heat to melt or burn it off, or by dissolution with a solvent.

The ratio of fiber to fugitive material is determined by the metal matrix-fiber ratio desired in the composite. For best results, a sufficient amount of fiber should be present in the pattern to assure minimum displacement of the fiber array in the mold cavity during and before infiltration of the molten metal. It is desirable to place screens at suitable positions relative to the pattern to maintain positioning of the fiber array while the fugitive material is removed and while the molten metal infiltrates the fiber array. The screens also serve to more evenly distribute the molten metal across the array.

As is well understood to one skilled in the art, an additional amount of fugitive material should be attached to the screens so that a reservoir zone or riser (4) will be present in the mold cavity when the heat-disposable material is driven off as will be more fully discussed below.

Tubes (3) or other conduits or gating are used to provide passageways into the mold through the wall of the mold. One convenient way to attach the conduits is to embed them in the fugitive material forming the riser. Alternatively the conduits may be attached to the screens as will be more fully disclosed below in the description of the operation of the process.

The mold (10) is then formed around the pattern and conduit assembly. The pattern and conduit assembly are coated for example, by spraying or by dipping into a ceramic material that is not readily wetted and resistant to penetration by the metal to be cast when the metal is in the molten state. Boron nitride is one such material and is preferably applied from a coater slurry. Boron nitride also makes separation of the mold from the cast composite structure easier. Further layers of ceramic particulate are then applied to the coated pattern. These layers can be applied by dipping in a slurry of the particulate and drying each layer in air, preferably with application of heat to hasten drying. A 325 mesh zircon slurry has been used with good results. To more rapidly increase the thickness of the mold and to enhance thermal shock resistance, one may apply a granular refractory material such as silica or zircon sand to the wet slurry coating before application of the next slurry coating.

A sufficient number of layers are applied to provide strength to the mold. The fugitive material is removed through the conduits with a solvent, by melting or firing or other well known techniques. The ceramic mold is then fired and the combustion products from residual fugitive material exit through the conduits leaving the fiber array substantially in place within the mold.

A ceramic sealant such as a glaze is then applied to the ceramic mold. This can be achieved by dipping, brushing or spraying of the glaze on the mold and firing. The function of the glaze is to seal the ceramic mold to prevent penetration of air or other gases into the mold when a vacuum is applied. The sealed structure also permits a greater vacuum to be applied. If desired, the sealant could be applied at an earlier stage of formation of the ceramic mold as before or between application of ceramic layers.

A molten bath of the metal to be infiltrated is prepared. Magnesium, aluminum, lead, copper or other metals may constitute the molten bath. A conduit of the ceramic mold is blocked or sealed off and a vacuum is applied to the mold via other conduit(s) to remove from the mold cavity any gases that could cause imperfections in the composite. The mold assembly is heated to a temperature at least as high as the melting point of the metal in the bath while a sealed conduit of the mold assembly is submerged below the surface of the molten metal bath with continued application of vacuum to the mold cavity. Preheating of the mold prevents premature solidification and poor penetration of the fiber array as the molten metal enters the mold cavity. The sealed conduit is then opened and molten metal is drawn into the mold cavity by the suction caused by the vacuum, optionally assisted by pressure forcing the molten metal into the mold cavity and proceeds to infiltrate the fiber array. Sufficient metal is drawn in to infiltrate the fiber array and to accumulate in the reservoir zone. The conduit is sealed once again as by crimping or by allowing a metal plug to form and the mold containing the fiber and molten metal is removed and cooled.

Cooling is preferably effected gradually starting at the section of the mold most distant from the reservoir zone and working toward the direction of the reservoir zone. Since the volume of metal shrinks upon solidification the molten metal in the reservoir zone provides the additional metal needed as the composite solidifies. Controlled cooling can be effected conveniently by placing the assembly in a heated zone and gradually removing the assembly from the heated zone such that the reservoir section is the last to be removed from the heated zone.

The ceramic mold and the conduits are then readily removed from the casting. With a minimum of finishing at the surface where the screens are present, one obtains a precision cast composite structure.

EXAMPLE 1

The preparation of patterns is shown in this Example.

The fibers used consisted of yarn containing 210 continuous polycrystalline alumina filaments having a diameter of about 20 microns of the type described in U.S. Pat. No. 3,828,839.

The above yarn was wound on a winder having a square drum. The yarn on the winder was coated with about a 20% solution of wax in a solvent to provide about 30% wax (based on total weight of fiber and wax). The coated yarn was allowed to dry in the air for about 24 hours. The winding, coating and drying sequence yielded a tape having a thickness of about 0.8 cm. The resulting tape on the winder was cut and removed.

The tape was cut into strips and the strips assembled to form a structure having a rectangular cross-section. The structure was consolidated by applying uniform pressure in a hydraulic press to a fiber volume loading of about 40% to form the pattern. It weighed 150 gm and was about 15 cm by 4 cm by 1 cm.

Two gating systems including risers and screens were attached to the pattern at appropriate places to allow for proper mold evacuation, mold filling, and solidification.

The gating system consisted of 1 cm diameter steel tubing welded to steel screening.

The pattern was then treated with a wetting solution to assure good wetting of the pattern during the subsequent prime coat dipping step. The wetting solution was prepared by adding 0.1% (by vol.) of a surfactant (Antarox BL240) to colloidal silica (Ludox).

After drying, a coating of boron nitride was applied from a slurry. After the boron nitride dried, five coatings of zircon slurry were applied.

The zircon slurry was prepared according to the following formulation:

| | Parts by Weight |
|---|---|
| Colloidal silica (Ludox ® HS 30) | 28 |
| Water | 4 |
| Zircon (325 mesh) | 100 |
| Nonionic low-foaming surfactant (Antarox BL-240) | 0.02 |

Each layer was allowed to dry in air for at least 2 hours. After the fifth layer dried, the coated pattern was dipped in the 325 mesh zircon slurry and while still wet was dipped in a fluidized bed of zircon sand (AFS grain fineness no. of 108–111) and allowed to dry. This was done to increase the ceramic shell thickness more rapidly. The thick shell provides increased thermal shock resistance and decreased shrinkage during drying. The operation was repeated to provide 20 such zircon slurry and zircon sand layers.

Three more coats of 325 mesh zircon slurry were applied to the mold. The mold was fired at 815° C. and the fugitive material burned off in one step. The ceramic mold now had a cavity containing alumina fiber. The mold was coated with a ceramic glaze (Amaco F-10 leadless F series with cones 06-05) and the coating was allowed to dry.

The tubing of one gating system was then attached to a vacuum while the other gating system was sealed. The assembly was placed in a furnace at 815° C. and vacuum was applied. When full vacuum was achieved (after the glaze had sintered and formed a sealing layer), the mold was removed from the furnace and the tubing of the sealed gating system was placed below the surface of a melt of commercially available magnesium ZE 41 alloy at about 700° C. The sealed tube seal was then opened while submerged beneath the surface of the melt and the molten metal allowed to infiltrate the ceramic mold and the fiber array contained therein. The tubing was then removed from the metal bath while vacuum was maintained. The ceramic mold was allowed to cool and was then separated from the metal matrix composite. The metal matrix composite so formed was then cleaned and the risers and gating removed. Metallographic examination of a cut cross-section of the composite did not show any porosity. The composite with a density of about 0.105 lb/in$^3$ has a distinct metallic sound when tapped with a metal bar. The resulting fiber reinforced magnesium composite is useful in applications such as aircraft structures where high strength is desirable.

EXAMPLE 2

The procedure of Example 1 was repeated in a general fashion to make an automobile connecting rod. The metal infiltrated was aluminum containing 2% lithium and the overall volume loading was about 15%. The glaze used was borosilicate 08644 from the O. Hummel Corp.

Provision was made for expansion of the metal gating by wrapping with a 5 mil layer of a waxy film that was removed by firing. The riser and distribution plate were coated with sufficient wax to allow for differences in expansion between metal and ceramic.

I claim:

1. A method for making an investment cast, fiber reinforced metal matrix composite in a ceramic mold comprising forming a pattern of the composite, said pattern comprising a fiber array impregnated with a fugitive material and provided with conduits at locations to permit mold evacuation and mold filling, coating the pattern with a ceramic material that is not readily wetted by the metal to be cast when the metal is in the molten state, applying a plurality of additional coatings of a slurry of ceramic particles to the pattern to form a ceramic mold around the pattern, each of said coatings being dried after application, applying a coating of a ceramic sealant, forming a cavity within the mold by treating the pattern to remove the fugitive material, said fiber array remaining substantially in place within the mold cavity, firing the ceramic sealant, heating the mold to a temperature above the melting point of the matrix metal, introducing molten metal through a conduit into the mold cavity while applying a vacuum to the mold cavity through another conduit, infiltrating the fiber array with the molten metal, cooling the ceramic mold and removing it from the cast composite.

2. The method of claim 1 wherein the coating that is first applied to the pattern is boron nitride.

3. The method of claim 1 wherein at least some of the applications of slurry are followed by application of a granular refractory material to the undried surface.

4. The method of claim 1 wherein the ceramic sealant is applied to the outer surface of the ceramic mold.

5. The method of claim 1 wherein introduction of the molten metal into the mold cavity is achieved by vacuum in the mold assisted by pressure applied to the molten metal.

* * * * *